United States Patent [19]

Abegg et al.

[11] Patent Number: 4,552,597

[45] Date of Patent: Nov. 12, 1985

[54] SOFT COMPOSITE EXPLOSIVES AND PROCESS FOR MAKING SAME

[75] Inventors: M. Taylor Abegg, Salt Lake City; John A. Peterson, Brigham City, both of Utah; Harvey A. Jessop, deceased, late of Lehi, Utah; by Ormond F. Lavery, personal representative, Sandy, Utah

[73] Assignee: Megabar Explosives Corporation, Ogden, Utah

[21] Appl. No.: 641,687

[22] Filed: Aug. 17, 1984

[51] Int. Cl.[4] ..... C06B 45/00

[52] U.S. Cl. ..... 149/2; 149/21; 149/38; 149/41; 149/42; 149/43; 149/44; 149/45; 149/46; 149/47; 149/61; 149/62; 149/76; 149/77; 149/83; 149/85; 149/88; 149/92

[58] Field of Search ..... 149/2, 21, 38, 41, 42, 149/43, 44, 45, 46, 47, 61, 62, 76, 77, 83, 85, 88, 92

[56] References Cited

U.S. PATENT DOCUMENTS

| | | | |
|---|---|---|---|
| 3,004,842 | 10/1961 | Rowlinson | 52/14 |
| 3,996,078 | 12/1976 | Klunsch et al. | 149/2 |
| 4,128,442 | 12/1978 | Barlow | 149/46 |
| 4,248,644 | 2/1981 | Healy | 149/21 |
| 4,274,893 | 6/1981 | Mars et al. | 149/2 |
| 4,391,659 | 7/1983 | Smith | 149/2 |
| 4,473,418 | 9/1984 | Bampfield et al. | 149/2 |
| 4,490,194 | 12/1984 | Cooper et al. | 149/2 |
| 4,490,195 | 12/1984 | Cooper et al. | 149/2 |

*Primary Examiner*—Stephen J. Lechert, Jr.
*Attorney, Agent, or Firm*—K. S. Cornaby

[57] ABSTRACT

A soft composite explosive composition is made by forming an oil-continuous, melt-in-fuel emulsion in which the discontinuous phase is comprised of ammonium nitrate and other ingredients which together form a eutectic mixture. The continuous phase includes a combination of fuels and emulsifiers constituting less than 2.5% by weight of the formulation. Soluble compounds such as self-explosive compounds or compounds which can be converted to explosive compounds in situ may be added directly to the discontinuous phase along with one or more oxidizer salts.

27 Claims, No Drawings

SOFT COMPOSITE EXPLOSIVES AND PROCESS FOR MAKING SAME

BACKGROUND OF THE INVENTION

The availability and low cost of ammonium nitrate (AN) have resulted in its widespread use in explosive formulations for commercial blasting. The simplest of these formulations is a mixture of AN and fuel oil (ANFO) in the ratio of approximately 94.5:5.5 by weight. Other formulations include a wide assortment of slurries and emulsions which have been developed to provide advantages over ANFO in handling, water resistance and improved performance.

The success of commercial AN formulations has attracted attention to the possible use of AN as a major ingredient in military explosives. For military applications, however, the developmental thrust has been directed primarily at ways of utilizing more effectively the energy available from explosives containing AN. Typically, AN formulations do not behave ideally in the explosive sense in that the energy release is not sufficiently prompt to yield theoretically possible detonation velocities and pressures. Development of methods to correct this deficiency has been an important part of military oriented research and development efforts over the past several years.

One approach has been to form low-melting eutectics comprised of AN and one or more explosive fuels. Eutectics offer increased intimacy of the ingredients, low melting points near those normally used in loading plants, and melt-cast properties compatible with conventional loading operations. Increased intimacy of the ingredients results in improved performance in some instances.

Typical of the eutectic composite formulations is one comprised of ethylenediamine dinitrate (EDD) and AN in the ratio 49:51 by weight (EA) with a melting point of approximately 103° C. When the AN portion is modified to contain a ratio of 85:15 AN/$KNO_3$by weight, the formulation is called EAK. Potassium nitrate ($KNO_3$) has been added to phase stabilize the AN. Other modifications may include an additional ingredient, such as nitroguanidine, which lowers the melting temperature still further, to approximately 98° C., when present to the extent of 8% by weight of the composition (NEAK). Another formulation typical of an AN based composite explosive is a 2:1 mole ratio of AN:ammonium 3,5-dinitro-1,2,4-triazolate.

A co-pending patent application, entitled Eutectic Microknit Composite Explosives (EMCX), teaches methodology by which essentially anhydrous emulsions of composite formulations such as EAK may be handled as a supercooled fluid while being loaded into containers before setting to a hard consistency.

Two U.S. Pat. Nos. 4,248,644 and 4,391,659, also teach emulsification technology in similar formulations. This prior art differs in part from EMCX technology in that the products retain a grease-like consistency, or are at least extrudeable and do not solidify. The first of the above cited patents limits the fuel concentration to a minimum of 2.5% and the emulsifier to a minimum of 1% by weight for a total of 3.5% by weight. The second patent deals with water-in-fuel emulsions as the final products.

It has not been apparent heretofore that grease-like, oil-continuous emulsified compositions can be made with significantly reduced oil phase and emulsifier concentrations. In fact, some emulsions have been found, as shown in the invention described below, to increase in stability, and to retain grease-like characteristics when the oil phase concentrations have been reduced substantially below those practiced in the prior art.

SUMMARY OF THE INVENTION

It is the objective of this invention to obtain soft composite explosive compositions by means of forming oil-continuous, melt-in-fuel emulsions in which the discontinuous phase is comprised of AN and other ingredients which together with AN form a eutectic mixture, and the continuous phase is comprised of a combination of fuel(s) and emulsifier(s) which together constitute less than 2.5% of the explosive formulation by weight. The other ingredients added directly to the discontinuous phase include soluble compounds which can be converted to explosive compounds in situ or soluble self-explosive compounds, along with one or more oxidizer salts. Different combinations of ingredients can be chosen to provide formulations with differing oxygen balances.

DETAILED DESCRIPTION OF PREFERRED EMBODIMENTS

Table I lists several example formulations of emulsified explosive compositions containing AN and other ingredients which reduce the melting point of the discontinuous portion of the emulsion.

TABLE 1

| | EXAMPLES: | | | | | | | |
|---|---|---|---|---|---|---|---|---|
| FORMULATIONS: | 1 | 2 | 3 | 4 | 5 | 6 | 7 | 8 |
| $NH_4NO_3$ | 44.9 | 45.7 | 44.8 | 44.4 | 46.0 | 42.7 | 67.0 | 68.5 |
| $KNO_3$ | | 7.9 | | | | | 14.0 | 14.0 |
| $KClO_4$ | 9.8 | | 9.8 | 9.7 | | 9.4 | 5.0 | 5.0 |
| EDD | 44.1 | 44.9 | 43.9 | 43.5 | | 41.9 | | |
| MEAN | | | | | 51.8 | | | |
| Glycerine | | | | | | | 10.0 | 10.0 |
| OAN | 0.3 | | | | | 2.0 | | |
| OAL | | | 0.4 | | 0.2 | | 0.4 | 0.4 |
| SMO | | 0.5 | | | | | 0.4 | 0.4 |
| $K^+$Lin | | | | 0.4 | | | | |
| SLS | | | | 0.3 | | | | |
| DDAN | | | | | 0.5 | | | |
| Mineral Oil | 0.9 | 1.0 | 1.1 | 1.7 | 1.5 | 4.0 | 1.2 | 1.2 |
| Microballoons | | | | | | | 2.0 | 0.5 |
| Consistency @ 20° C. | Gr | Gr | Gr | Gr | P | S | Gr | Gr |
| Density (g/cc) | 1.50 | 1.50 | 1.55 | 1.55 | 1.50 | | 1.25 | 1.48 |
| Results in 3.8 cm | R | R | R | R | DET | no | DET | DET |

TABLE 1-continued

| FORMULATIONS: | EXAMPLES: 1 | 2 | 3 | 4 | 5 | 6 | 7 | 8 |
|---|---|---|---|---|---|---|---|---|
| diameter #8 cap | | | | | | test | | |

KEY
EDD - Ethylenediamine Dinitrate
MEAN - Monoethanolamine Nitrate
OAN - Oleyl Amine Nitrate
OAL - Oleyl Amine Linoleate
SMO - Sorbitan Monooleate
$K^+$Lin - Potassium Linoleate
SLS - Sodium Lauryl Sulfate
DDAN - Dodecyl Amine Nitrate
Gr - Grease-like
R - Strong reaction, but sample failed to detonate completely
P - Paste
S - Solid
Microballoons - Used for sensitization. Other sensitizers, such as perlite, fumed silica, entrained gas, and/or gas generated in situ may be subsituted.

Examples 1 through 5 show that various types of emulsifiers can be employed for making oil-continuous emulsions using low concentrations of oil phase. Formulations 7 and 8 are examples of formulations which do not contain compound explosives.

Example 6, with an oil phase concentration of 6% by weight, was included to show that a higher oil phase concentration can produce a hard rather than soft product. Examples 1,3 and 4 with oil phase concentrations ranging from 1.2% to 2.4% by weight illustrate that soft grease-like products can be made at these lower oil phase concentrations.

The methodology used to make formulations 1–8 is typical of that used in conventional emulsion technology. Laboratory methods usually involved reverse order addition, i.e., slowly adding the molten eutectic portion to a preheated mixture of oil and emulsifier while stirring continually. Direct order addition was also found to be applicable. The emulsions of this invention can be made by either continuous or batch methods.

A preferred oxygen balance for a given formulation can be achieved by selection of ingredients. The preferred oxygen balance range is from +5 to −30%. If the formulation contains a metallic fuel, the preferred oxygen balance range is from +5 to −50%.

We claim:

1. An essentially anhydrous soft composite explosive composition comprising a melt-in-fuel emulsion in which the discontinuous phase is a eutectic mixture comprised of ammonium nitrate and at least one soluble compound with at least one other oxidizer salt, and in which the continuous phase is a mixture of at least one emulsifier and at least one fuel, comprising less than 2.5% by weight of the explosive composition.

2. A composition as set forth in claim 1, wherein moisture is limited to 3% maximum by weight of the composition.

3. A composition as set forth in claim 1, wherein the oxygen balance is between +5 and −30%.

4. A composition as set forth in claim 1, wherein the composition includes metallic fuels and the oxygen balance is between +5 and −50%.

5. A composition as set forth in claim 1, wherein the emulsifier concentration is less than 1.0% by weight of the explosive composition.

6. A composition as set forth in claim 1, wherein at least one inorganic nitrate, perchlorate or combination thereof is added in conjunction with $NH_4NO_3$ in the eutectic portion of the emulsion, and the concentration of added oxidizer salts is at most the same as the percentage by weight of $NH_4NO_3$ in the explosive composition.

7. A composition as set forth in claim 6, wherein the added oxidizer salts are from the group consisting of alkali and alkaline earth nitrates and perchlorates and ammonium perchlorate.

8. A composition as set forth in claim 7, wherein the added oxidizers are selected from the group consisting of $Zn(NO_3)_2$, $Mn(NO_3)_2$, $Cu(NO_3)_2$, $Pb(NO_3)_2$ and their perchlorate analogs.

9. A composition as set forth in claim 6, wherein a soluble and compatible potassium salt is added to phase-stabilize the ammonium nitrate.

10. A combination as set forth in claim 1, wherein the fuel is a hydrocarbon oil, and wherein the fuel concentration is less than 2.5% by weight of the explosive composition.

11. A composition as set forth in claim 1, wherein the emulsifier is selected from the group consisting of anionic, cationic or non-ionic emulsifiers, and has R-groups containing from 10 to 22 carbon atoms.

12. A composition as set forth in claim 1, wherein an originally fluid mixture is employed as a matrix into which at least one insoluble solid is added.

13. A composition as set forth in claim 12, wherein the added insoluble solid is a compound explosive.

14. A composition as set forth in claim 12, wherein the added insoluble solid is a metallic fuel.

15. A composition as set forth in claim 12, wherein the added insoluble solid is an oxidizer.

16. A composition as set forth in claim 1, wherein at least one soluble compound explosive is added.

17. A composition as set forth in claim 16, wherein the soluble compound explosive is made in situ.

18. A composition as set forth in claim 16, wherein the soluble compound explosive is selected from the group consisting of the nitrate or perchlorate adducts of an alkylamine, an alkanolamine and a combination thereof.

19. A composition as set forth in claim 16, wherein the added soluble compound explosive is an oxidizer.

20. A composition as set forth in claim 16, wherein the added soluble compound explosive is selected from the group consisting of hexamethylenetetramine nitrates and perchlorates.

21. A composition as set forth in claim 16, wherein the soluble compound explosive is selected from the group consisting of metal ammonia coordination compounds.

22. A composition as set forth in claim 16, wherein the soluble compound explosive is a nitroazole salt.

23. A composition as set forth in claim 17, wherein the soluble compound explosive is selected from the group consisting of the nitrate or perchlorate adducts of an alkylamine, an alkanolamine and a combination thereof.

24. A composition as set forth in claim 17, wherein the added soluble compound explosive is an oxidizer.

25. A composition as set forth in claim 1, wherein the added compound is a non-self-explosive fuel which is soluble in the discontinuous portion of the emulsion.

26. A composition as set forth in claim 1, wherein density control and sensitization is achieved by the use of additives selected from the group consisting of microballoons, perlite, fumed silica, entrained gas, or gas generated in situ.

27. A composition as set forth in claim 1, wherein sensitization is effected in the absence of density control or the addition of compound explosives.

* * * * *